US009318244B2

(12) United States Patent
Takahashi et al.

(10) Patent No.: US 9,318,244 B2
(45) Date of Patent: Apr. 19, 2016

(54) SOFT MAGNETIC POWDER CORE

(71) Applicant: TDK CORPORATION, Tokyo (JP)

(72) Inventors: Takeshi Takahashi, Tokyo (JP); Seigo Tokoro, Tokyo (JP); Seiichi Kikuchi, Tokyo (JP); Kenichi Nishikawa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 91 days.

(21) Appl. No.: 14/379,023

(22) PCT Filed: Feb. 4, 2013

(86) PCT No.: PCT/JP2013/052431

§ 371 (c)(1),
(2) Date: Aug. 15, 2014

(87) PCT Pub. No.: WO2013/121901

PCT Pub. Date: Aug. 22, 2013

(65) Prior Publication Data

US 2015/0021512 A1 Jan. 22, 2015

(30) Foreign Application Priority Data

Feb. 17, 2012 (JP) ..... 2012-032684

(51) Int. Cl.

| | |
|---|---|
| ***H01F 1/24*** | (2006.01) |
| ***H01F 1/33*** | (2006.01) |
| ***B22F 1/02*** | (2006.01) |
| ***B22F 3/02*** | (2006.01) |

(Continued)

(52) U.S. Cl.

CPC .. *H01F 1/01* (2013.01); *B22F 1/02* (2013.01); *C22C 33/02* (2013.01); *H01F 1/24* (2013.01); *H01F 1/33* (2013.01); *H01F 3/08* (2013.01); *C22C 2202/02* (2013.01); *H01F 27/255* (2013.01)

(58) Field of Classification Search

CPC ..... H01F 1/24; H01F 1/33; H01F 3/08; H01F 27/253

See application file for complete search history.

(56) References Cited

U.S. PATENT DOCUMENTS

| | | | |
|---|---|---|---|
| 2003/0230362 | A1 | 12/2003 | Tajima et al. |
| 2009/0116990 | A1 | 5/2009 | Unoki et al. |

FOREIGN PATENT DOCUMENTS

| | | |
|---|---|---|
| EP | 2 219 195 A1 | 8/2010 |
| JP | A-2007-12994 | 1/2007 |
| JP | B-4060101 | 3/2008 |
| JP | A-2009-117651 | 5/2009 |
| JP | A-2010-141183 | 6/2010 |
| JP | A-2010-238914 | 10/2010 |

OTHER PUBLICATIONS

May 7, 2013 Written Opinion issued in International Application No. PCT/JP2013/052431 (with translation).

(Continued)

*Primary Examiner* — Carol M Koslow
(74) *Attorney, Agent, or Firm* — Oliff PLC

(57) ABSTRACT

A soft magnetic powder core which can have a high electrical resistivity, a high magnetic flux density and a high strength easily, and the soft magnetic powder core can be used in various electromagnetic components such as a motor, an actuator, a generator and a reactor. The soft magnetic powder core in which the glass portion is scattered among the soft magnetic particles, the soft magnetic particle having the core particle with iron as the main component and the insulating coating layer containing P, O and Fe. Further, the junction portion with iron oxide as the main component is formed between the soft magnetic particle and the glass portion.

16 Claims, 5 Drawing Sheets

(51) Int. Cl.

| | |
|---|---|
| ***H01F 1/01*** | (2006.01) |
| ***H01F 3/08*** | (2006.01) |
| ***C22C 33/02*** | (2006.01) |
| *H01F 27/255* | (2006.01) |

(56) References Cited

OTHER PUBLICATIONS

May 7, 2013 International Search Report issued in International Application No. PCT/JP2013/052431 (with translation).

SOFT MAGNETIC POWDER CORE

The present invention relates to a soft magnetic powder core which has a high electrical resistivity, a high magnetic flux density and a high strength and is used in various electromagnetic components such as a motor, an actuator, a generator and a reactor.

BACKGROUND

Up to now, the powder core using soft magnetic materials is being developed as the magnetic core for the motor, actuator, generator, reactor or the like. Generally speaking, the magnetic core prepared by compressing the powder has a relatively low mechanical strength or a relatively low magnetic flux density compared to the silicon steel plate. As a producing method for overcoming these problems, it has been proposed a scheme in which the pressure for the molding process or the temperature in the heat treatment is elevated.

However, the powder core prepared by such treatments has a low electrical resistivity as the insulating film formed on the surface of the particle is likely to peel off or break up. The eddy current in the magnetic core will increase if the electrical resistivity is lowered. In this way, the output or the efficiency of the product will also decrease. Therefore, there is no soft magnetic powder core that can possess a high electrical resistivity, a high magnetic flux density and a high strength at the same time.

In order to solve these technical problems mentioned above, Patent Document 1 has disclosed a technology that the iron powder on which a coating film containing MgO is formed and the silicon resin are mixed and molded to give a powder core, and the molded powder core is subjected to a firing process at a temperature of 550° C. to 750° C. under a non-oxidative atmosphere followed by a heat treatment at a temperature of 400° C. to 560° C. under an oxidative atmosphere. In addition, Patent Document 2 has disclosed a technology that a compound or salt which generates a cation having a valence of 2 or more with boric acid or phosphoric acid is used to form an insulating coating film on the iron powder. Further, a technology has been disclosed in Patent Document 3 that soft magnetic particles with an insulating coating film, glass with a low melting point and an average particle size of 2 nm to 200 nm, and a lubricant are mixed and compressed and then a firing treatment is provided to the mixture at a temperature of 650° C.

PATENT DOCUMENTS

Patent Document 1: JP-A-2009-117651
Patent Document 2: JP-A-04060101
Patent Document 3: JP-A-2010-238914

SUMMARY

However, in the technology of Patent Document 1, the magnetic flux density is not sufficient despite of a high bending strength and a high electrical resistivity (specific resistance). In addition, as a very long production process as well as a heat treatment at a high temperature is needed to gain a high bending strength, it costs time and money.

In addition, in the technology disclosed in Patent Document 2, a heat treatment can be provided at a high temperature by improving the heat resistance of the insulating film. With the heat treatment at a high temperature, the distortion inside the magnetic core can be eliminated and a high magnetic flux density can be obtained. However, thus prepared powder core will not possess a high magnetic flux density and a high specific resistance at the same time. Also, the mechanical strength will not be sufficient.

Further, in the technology of Patent Document 3, glass with a low melting point and an average particle size of 2 nm to 200 nm is mixed therein in order to improve the strength. However, the bending strength, the magnetic flux density and the specific resistance of the resultant powder core are relatively low and not sufficient.

In view of the situation mentioned above, the present invention has been completed. The present invention aims to provide a soft magnetic powder core with which a powder core having a high electrical resistivity, a high magnetic flux density and a high strength can be easily prepared.

In order to solve the technical problem mentioned above and to achieve the goals, the soft magnetic powder core in present invention is characterized in that the glass portion is scattered among soft magnetic particles in the powder core, wherein, the soft magnetic particle has a core particle with iron being the main component and an insulating coating layer containing at least P, O and Fe. In addition, a junction portion with iron oxide as the main component is formed between the soft magnetic particle and the glass portion.

It can be known from the measurement on the electromagnetic property and the mechanical property of the soft magnetic powder core that the powder core of the present invention has a higher electrical resistivity, a higher magnetic flux density and a higher strength than the conventional soft magnetic powder cores. The underlying mechanism for such effects are not clear but is presumed to be as follows.

In the powder core in which the glass portion is scattered among soft magnetic particles, a lot of the glass portions will fill the spaces among the soft magnetic particles inside the soft magnetic powder core. As the space will be the starting point of destroy in the strength test such as three point bending flexural test, the mechanical strength will be improved with the filling of these glass portions. In addition, the distance among soft magnetic particles will be close if no glass portion is present among the particles, then the magnetic interaction among these particles will be quite strong. In this respect, the magnetic flux density of the soft magnetic powder core will be improved. Further, the soft magnetic particle is highly magnetized as the core particle uses iron as the main component. With the insulating coating layer containing at least P, O and Fe on the core particles, the particles are insulated. In this way, the electric resistivity is improved in the soft magnetic powder core. In addition, the adhesion at the interface between the soft magnetic particle and the glass portion is further improved by forming a junction portion with iron oxide as the main component between the soft magnetic particle and the glass portion. Thus, a soft magnetic powder core is provided with a higher strength.

As an ideal embodiment in the present invention, the insulating coating layer which contains at least P, O and Fe further contains at least one or more elements selected from the group consisting of B, Na, Zn and Ba. The insulativity of the insulating coating layer is further improved by choosing these elements. In addition, it becomes easily to form a junction portion with iron oxide as the main component between the soft magnetic particle and the glass portion by the selectively reacting of the insulating coating layer with the starting glass particle via a heat treatment. Therefore, a powder core can be prepared to have a further improved electrical resistivity and a high mechanical strength.

The glass portion contains Bi, Fe and P and is formed by compression molding the starting glass particle, reacting the glass particle with the soft magnetic particle via a heat treatment, cohering the resultant substances and making the composition changed. The starting glass particle preferably contains Bi as the main component and has a glass transition temperature point and a softening point of 500° C. or lower. In such a case, the soft magnetic particle is likely to react with the starting glass particle. In addition, the glass portion further contains Fe and P so that the adhesion between the glass portion and the junction portion becomes stronger and the mechanical strength becomes higher.

The soft magnetic powder core contains Bi. The amount of Bi is preferably 0.05 mass % or more and 4.00 mass % or less, and more preferably 0.10 mass % or more and 0.20 mass % or less. When Bi contained in the soft magnetic powder core is within the range mentioned above, the magnetic flux density is high and the mechanical strength can be further elevated.

The area ratio occupied by the glass portion is preferably 0.1% or more and 5.0% or less in any cross section of the soft magnetic powder core having an area of 1.1 $mm^2$ or more and 1.2 $mm^2$ or less. In addition, and the average area of the glass portion is preferably 10 $\mu m^2$ or more and 40 $\mu m^2$ or less. When the area ratio and the average area of the glass portion are within the ranges mentioned above, the glass portion is better distributed and the mechanical strength of the soft magnetic powder core can be further improved.

Because of the high electrical resistivity, the high magnetic flux density and the high strength, the soft magnetic powder core obtained in the present invention can be used in the motor, actuator, generator, reactor and the like.

DETAILED DESCRIPTION OF EMBODIMENTS

Figure 1:
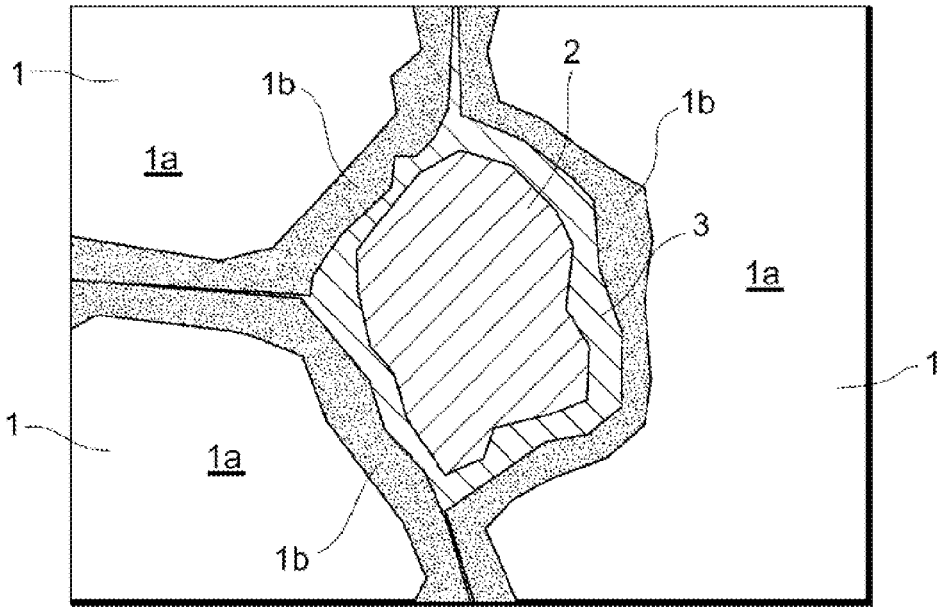
FIG. 1 is a schematic cross section showing the soft magnetic powder core in the present embodiment.

Hereinafter, the embodiments of the present invention will be described. However, the positional relationship is based on those shown in the drawings as long as it is not particularly specified and the dimensional proportion is not limited to those shown in the Figures. Further, the following embodiments are exemplary, and the present invention is not limited to these embodiments.

The soft magnetic powder core is characterized in that it is an aggregate (pressurized powder) of soft magnetic particles 1 and scattered glass portions 2, wherein the soft magnetic particle 1 is provided with a core particle 1*a* with iron as the main component and an insulting coating film 1*b* containing P, O and Fe, and a junction portion 3 with iron oxide as the main component is formed between the soft magnetic particle 1 and the glass portion 2.

FIG. 1 is a schematic cross section showing an embodiment of the soft magnetic powder core in the present embodiment. The soft magnetic particle 1 has the insulating coating layer 1*b* (which at least contains P, O and Fe) on the surface of the core particle 1*a*, and the glass portions 2 is present (scattered) among the soft magnetic particles 1. In addition, the junction portion 3 is formed between the soft magnetic particle 1 and the glass portion 2.

The core particle 1*a* is iron based powder (particle, powder) with iron as the main component, wherein the iron based powder includes the pure iron and iron containing inevitable impurities. The specific example of the core particle 1*a* can be for example the pure iron or a composition having a small amount of other elements (such as Si, P, Co, Ni, Cr, Al, Mo, Mn, Cu, Sn, Zn, B, V, Sn and the like) added to the iron. In addition, besides the metallic simple substance or the composition of the metallic simple substance and other elements, the core particle 1*a* can also be alloy such as the Fe—Si based alloy, Fe—Al based alloy, Fe—N based alloy, Fe—C based alloy, Fe—B based alloy, Fe—Co based alloy, Fe—P based alloy, Fe—Ni—Co based alloy, Fe—Cr based alloy, Fe—Al—Si based alloy. They can be used alone, or two or more can be used in combination.

The preferable core particle 1*a* is not particularly restricted. For example, it can be composed of a composition containing 95 mass % or more of iron. More preferably, it can be composed of the pure iron containing 99 mass % or more of iron. Compared to the conventional Fe—Al—Si based alloy powder or the iron based particle with a purity that is less than 95 mass %, the soft magnetic particle containing a larger quantity of iron will result in a higher density and an improved magnetic flux density as the particle has a low Vickers hardness and the moldability tends to be excellent. More preferably, the core particle contains 0.5 mass % or less of P, 0.1 mass % or less of Mn, 0.03 mass % or less of Al, V, Cu, As and Mo and a balance of iron.

The average particle size of the core particles 1*a* is preferably 10 μm or more and 500 μm or less, and more preferably 50 μm or more and 200 μm or less. When the average particle size is 10 μm or more, the spaces inside the soft magnetic powder core become less and the molding density increases so that the magnetic flux density is improved. If the average particle size is 500 μm or less, the heat generation and loss in the soft magnetic powder core can be inhibited as the eddy current inside the particles can be prevented from generating. Here, the average particle size refers to the D50% particle size.

The core particle 1*a* can be produced by a well known method and the method is not particularly limited. For example, the well known method such as the ore reducing method, the mechanical alloying method, the gas atomizing method, the water atomizing method, the rotary atomizing method, the electrolysis method, the casting pulverizing method and the like can be used to produce particles with any composition and any particle size.

The material for forming the insulating coating layer 1*b* is a material that provides insulativity and contains at least Fe, P and O. For example, the material can be the phosphite compounds of Fe, the phosphate compounds of Fe, the hydrophosphate compounds of Fe, the pyrophosphate compounds of Fe, the oxide of Fe and the like. One of these compounds can be contained, or multiple compounds can be contained. In addition, the insulating coating layer 1*b* preferably contains at least iron phosphate. As the adhesion between the iron phosphate and the core particle 1*a* with iron as the main component is high, the mechanical strength can be increased.

Further, the film thickness of the insulating coating layer 1*b* is preferably 10 nm or more and 500 nm or less, and further preferably 40 nm or more and 300 nm or less. If the film thickness is 40 nm or more, the particles can be further insulated between each other and the electrical resistivity can be increased. If the film thickness if 300 nm or less, the core particles become closer to each other so that the magnetic interaction becomes stronger and the magnetic flux density becomes larger.

The glass portion 2 is formed by mixing the starting glass material and the soft magnetic material, compression molding the mixture and providing the resultant substances with a heat treatment. The glass portion 2 is preferably formed by making Fe and P diffused during the heat treatment of the soft magnetic powder core to the starting glass particles which have not been heat treated. It is more preferably that the diffusion level of Fe is higher than that of P under the action of heat. The thus formed glass portion has a close adhesion with the simultaneously formed junction portion, and the mechanical strength can be improved.

The average particle size of the starting glass particles is preferably 0.5 μm or more and 10 μm or less, and more preferably 1 μm or more and 5 μm or less. If the average particle size of the starting glass particle is 0.5 μm or more, these glass particles will well fill the spaces among the soft magnetic particles so that the mechanical strength can be increased. On the other hand, if the average particle size of the starting glass particle is 10 μm or less, the density of the molded body can be prevented from decreasing and the magnetic flux density can be increased.

The junction portion 3 is only selectively formed between the soft magnetic particle 1 and the glass portion 2 with iron oxide as the main component. Here, the so called "iron oxide" includes FeO, $Fe_2O_3$ and $Fe_3O_4$, and it is preferable that more $Fe_3O_4$ is contained. The junction portion containing more $Fe_3O_4$ will be harder, so the mechanical strength will be increased. Further, the junction portion with iron oxide as the main component is only selectively formed around the glass portion but not formed in the whole space among the insulating coating layers. In this way, the electrical resistivity among particles can be prevented from decreasing but to be increased.

Further, in the junction portion 3, the sum of Fe (at. %) and O (at. %) is preferably 80 at. % or more in the content analysis of the elements via TEM-EDS in which elements lighter than C are excluded. It is more preferably that the sum of Fe and O is 90 at. % or more. The thus formed junction portion 3 contains more iron oxides and firmly connects the soft magnetic particle 1 to the glass portion 2.

Here, the thickness of the junction portion 3 is preferably 5 nm or more and 100 nm or less, and more preferably 10 nm or more and 50 nm or less. If the thickness of the junction portion 3 is 5 nm or more, the adhesion between the soft magnetic particle and the glass portion is improved so that a higher strength can be obtained. Further, if the thickness of the junction portion 3 is 100 nm or less, the stresses applied inside the junction portion 3 are hard to gather so that a higher strength can be obtained.

The insulating coating layer 1*b* contains at least one element selected from the group consisting of B, Na, Zn and Ba. The ones selected from these elements (the additive elements) are diffused from the starting glass particles via the heat treatment so that they will be contained in the insulating coating layer. These elements are preferably contained inside the insulating coating layer as phosphates and the oxides before the heat treatment. If the phosphates and the oxides of these elements are contained before the heat treatment, the reaction between them and the starting glass particle can be activated via the heat treatment so that the junction portion can be easily formed. In addition, the phosphates or the oxides of these elements are more stable than Fe, so Fe is promoted to diffuse from the coating film to the starting glass particle while P is prevented from excessively diffusing to the junction portion. In this respect, the adhesion between the insulating coating layer and the junction portion is improved so as to obtain a higher strength.

The stability of the phosphate is determined by its solubility in water at 25° C. with an order of $Ba_3(PO_4)_2>Zn_3(PO_4)_2>FePO_4$. The stability of the oxide is derived from its generated standard free energy with an order of $BaO>B_2O_3>Na_2O>Fe_3O_4$ at 500° C. or lower.

The reaction between the soft magnetic particle and the starting glass particle is not particularly restricted, but the following reactions are preferable. If the phosphates of the additive elements have a higher stability than that of iron phosphate, the diffusion of iron oxide will be promoted because iron phosphate will be decomposed via heat and then oxidized easily. On the other hand, the phosphates of the additive elements are stable so the dispersion of P is inhibited. If the oxides of the additive elements have a higher stability than that of iron oxide ($Fe_3O_4$) as well as a low melting point, the oxides of the additive elements generated via heat will make the melting point of the starting glass particles become lower. In this respect, the dispersion of the iron oxide will be quite easy. That is, the dispersion is promoted so that the junction portion is formed and the mechanical strength is improved.

The glass portion 2 is characterized in that it contains Bi, Fe and P. The glass portion is obtained by mixing the starting glass material with Bi as the main component and the soft magnetic material, compression molding the mixture and providing a heat treatment. The starting glass material is preferable to be for example the $Bi_2O_3$—$B_2O_3$ based glass, the $Bi_2O_3$—ZnO—$B_2O_3$ based glass and the like. It is more preferable that the material further contains P and Fe. In addition, the material preferably contains 60 mass % or more of Bi, and more preferably contains 75 mass % or more of Bi. The starting glass with the ranges mentioned above forms the junction portion to increase the mechanical strength because its transition point and softening point are lowered and Fe and P can easily diffuse to the starting glass particles.

The content of Bi contained in the soft magnetic powder core can be measured by an ICP-AES measuring device or the like. As the amount of Bi mainly depends on the amount of the added glass, so the amount of Bi is preferably 0.05 mass % or more and 4.00 mass % or less and more preferably 0.1 mass % or more and 2.0 mass % or less. If the content of Bi is 0.05 mass % or more, the spaces in the soft magnetic powder core will be filled up with the glass particles so that the mechanical strength will be improved. When the content of Bi is 4.00 mass % or less, the decrease of the magnetic flux density will be inhibited and the mechanical strength will be increased.

The distribution state of the glass portion inside the soft magnetic powder core can be determined by the imaging method. It is preferable that the area ratio of the glass portion is preferably 0.1% or more and 5.0% or less in any cross section of the soft magnetic powder core having an area of 1.1 $mm^2$ or more and 1.2 $mm^2$ or less, and the average area of the glass portion is preferably 10 $\mu m^2$ or more and 40 $\mu m^2$ or less. When the area ratio and the average area of the glass portion fall within the ranges mentioned above, the dispersity of the glass portion will become better and the mechanical strength of the soft magnetic powder core will be further increased.

Figure 2:
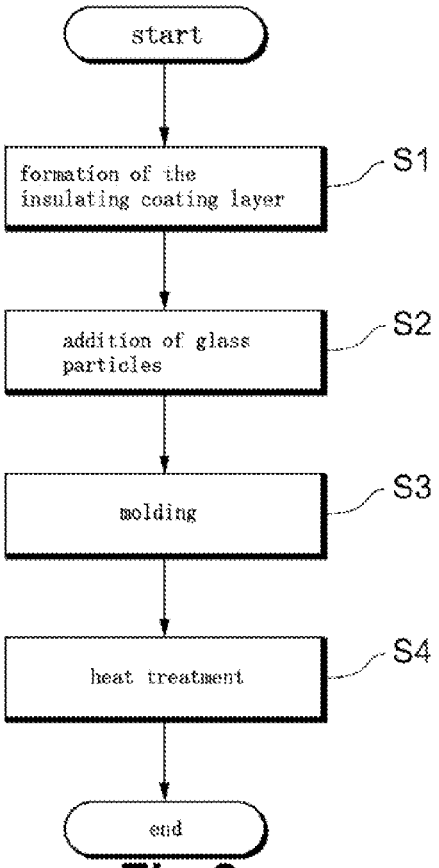
FIG. 2 is a flowchart showing an example of the order for producing the soft magnetic powder core of the present embodiment.

FIG. 2 is a flowchart showing an example of the order for producing the soft magnetic powder core of the present embodiment. Here, the soft magnetic particle (the soft magnetic material) with iron as the main component is produced by a process (S1) in which an insulating coating layer is formed on the core particle (the starting powder). Then, the glass portion 2 and the junction portion 3 are formed by a process S2 in which starting glass material is added to the soft magnetic material, a process S3 during which the resultant mixture is molded and a process S4 in which a heat treatment is provided to the molded body obtained after the molding process. In this way, the soft magnetic powder core is prepared which contains the soft magnetic particles 1, the glass portions 2 and the junction portions 3 mentioned above.

In the process S1 in which the insulating layer is formed on the starting powder, the phosphoric acid (such as the aqueous solution of 80 to 90% orthophosphoric acid ($H_3PO_4$)) and the simple substances or the compounds of the additive elements are mixed and dissolved to prepare a solution for the insulating layer coating treatment. This solution is coated on the starting powder and left to be dried so that an insulating layer is formed. In this case, the insulating layer can also be a coating film with multiple layers which is prepared by coating the aqueous solution with only phosphoric acid on the starting powder, leaving the solution to be dried and then further coating a solution with the compounds of the additive elements and making them dried. In this way, the soft magnetic material mentioned above is prepared. The method for coating the solution for the insulating layer coating treatment is not particularly restricted. Well known means can be appropriately employed with an example in which the solution for the insulating layer coating treatment and the core particle are mixed and the mixture is then dried.

The compound of the additive element can be, for example, the phosphite, the phosphate, the pyrophosphate, the oxide, the hydroxide, the oxoacid and the oxoacid salt. The phosphates, oxides and oxoacids of the additive elements are preferred.

The specific example of the compound can be disodium hydrogenphosphite(pentahydrate), boron phosphate, sodium dihydrogenphosphate, sodium dihydrogenphosphate(dihydrate), disodium hydrogenphosphate, disodium hydrogenphosphate(pentahydrate), disodium hydrogenphosphate (dodecahydrate), trisodium phosphate, trisodium phosphate (hexahydrate), trisodium phosphate(dodecahydrate), zinc dihydrogen phosphate, zinc phosphate, zinc phosphate(tetrahydrate), barium hydrogenphosphate, tetrasodium pyrophosphate, tetra-sodium pyrophosphate(decahydrate), disodium dihydrogenpyrophosphate, zinc pyrophosphate (trihydrate), barium pyrophosphate, boric oxide, sodium oxide, zinc oxide, barium oxide, sodium hydroxide, zinc hydroxide, barium hydroxide, barium hydroxide(octahydrate), boric acid, sodium zincate, sodium metaborate(tetrahydrate), zinc borate(3.5-hydrate), sodium tetraborate (decahydrate) and the like.

Further, when the solution for the insulating layer coating treatment is coated, a mixing mill, a mixer, an agitator, a granulator or a disperser and the like can be used as needed to perform the mixing treatment. In order to improve the uniformity and the adhesion of the insulating coating layer, the spraying method is preferable, wherein in such a method the coating solution in which the phosphoric acid and the simple substances or the compounds of the additive elements are dispersed or dissolved in a solvent is sprayed by a spraying gun or the like to coat the coating solution on the core particles. In the spraying method, the solvent to be used can be, for example, water and an organic solvent such as toluene, acetone and alcohols. The solvent is not particularly restricted.

In the process S2 in which the starting glass material is added in the soft magnetic material, if the added starting glass material is to be uniformly dispersed in the soft magnetic material, the mixture mentioned above is preferably mixed. The mixing process can be done by a well-known method. There is no particular restriction on the method. However, the mixing process is preferably performed by a mixer (such as a flash blender, a rocking shaker, a drum shaker or a V-shaped mixer) or a granulator (such as a fluid granulator, a tumbling granulator or the like), and etc.

In the molding process S3, the mixture obtained above (i.e., the mixture containing the soft magnetic material and the starting glass material) is injected to a mold coated with a lubricant and then molded into any shape under pressure at the normal temperature or a heated temperature. Such a molding process can be done by a well known method and the method is not particularly restricted. However, it is preferable that a mold with a cavity having a desired shape is used and the mixture is filled in the cavity after the mold is coated by the lubricant. Then, the mixture is subjected to the compression molding under a specified pressure for molding.

Here, a lubricant well known in the present art can be appropriately selected as the lubricant. The lubricant is not particularly restricted but is preferred to be a metallic soap. The lubricant will reduce the friction between the soft magnetic powder and the mold during the molding process and prevent the material from being gnawed. The metallic soap is likely to uniformly attach to the inner side of the mold so that the moldability will be excellent. The specific example of the metallic soap can be, for example, zinc oleate, zinc stearate, aluminium stearate, calcium stearate, lithium stearate or the like.

The method for coating the lubricant on the mold is preferably one in which the lubricant is charged with static electricity, or a method in which a mixture obtained by mixing the lubricant with an organic solvent is sprayed by a sprayer and then dried. The specific example of the organic solvent can be methanol, ethanol, isopropyl alcohol, acetone, methyl ethyl ketone and the like. However, the solvent is not particularly limited.

The pressure during the molding process is not particularly restricted but is usually 600 MPa or more and 1200 MPa or less. If the pressure during the molding process is set to be 600 MPa or higher, both the density and the magnetic permeability tend to be higher after the molding process. In addition, if the pressure during the molding process is controlled to be 1200 MPa or less, the saturation of the effect by pressure application tends to be inhibited and it tends to be excellent in the productivity and the economy. Further, with respect to the mold, the deterioration tends to be inhibited and the durability tends to be improved.

Further, if the molding process is performed at a heated temperature, the temperature during the molding process is not particularly limited but is often 80° C. or higher and 200° C. or lower. Preferably, the temperature is 100° C. or higher and 160° C. or lower. In addition, the higher the temperature during the warm forming process is, the higher density the molded body tends to have. However, if the temperature during the molding process is controlled to be 200° C. or lower, the oxidization of the core particle (the soft magnetic particle) can be properly controlled, and the performance deterioration of the obtained soft magnetic powder core can be inhibited. In addition, it is excellent in the productivity and the economy.

In process S4 during which a heat treatment is provided to the molded body obtained after the molding process, the compressive strain generated during the molding process is released so that the magnetic flux density is increased and the loss of the magnetic core (especially the hysteresis loss) is lowered. The heat treatment can be performed by a well known method. The method is not particularly restricted but is usually preferably performed by using an annealing furnace to provide a heat treatment at a specified temperature to the molded body of the soft magnetic material which has been molded into any shape.

The temperature in the heat treatment is not particularly restricted but is usually about 450 to 500° C. If the temperature during the heat treatment is 450° C. or higher, the strain of the core particle can be released and the magnetic flux density can be improved. Further, the reaction between the insulating coating layer and the starting glass particle proceeds properly to form the junction portion so that the mechanical strength is elevated. By setting the temperature during the heat treatment as 500° C. or lower, the decomposition of the insulating coating layer is inhibited while the mechanical strength and the insulativity can be maintained. Also, the magnetic flux density will become higher.

The heat treatment is preferably done under an oxygen-containing atmosphere. Here, the oxygen-containing atmosphere can be, for example, the air (which usually contains 20.95% of oxygen) or a mixed atmosphere of the inert gas (such as argon or nitrogen) and oxygen. However, the atmosphere is not limited to these. With the heat treatment under an oxygen-containing atmosphere, the insulating coating layer as well as the junction portion with iron oxide as the main component can be formed. In this respect, the soft magnetic powder core is formed to have a high mechanical strength.

The thus obtained soft magnetic powder core has a high density and is excellent in terms of various properties such as the high electrical resistivity, the high magnetic flux density, the high strength or the like.

EXAMPLES

Hereinafter, the present invention will be described in detail based on the Examples. However, the present invention is not limited to these Examples.

[Production Method]

Examples 1 to 8 and Comparative Example 1

The pure iron (trade name: ABC100.30, with an average particle size of 100 μm, made by Höganäs AB) was prepared as the core particle with iron as the main component (the stating powder). Then, phosphoric acid of 0.2 mass % relative to the starting powder and the additive materials listed in Table 1 with their total amount being 0.004 mass % relative to the starting powder were dissolved in isopropyl alcohol (IPA) to prepare a solution for the insulating layer coating treatment. After that, the starting powder and the solution for the insulating layer coating treatment were mixed and left to be dried so as to produce the soft magnetic material.

TABLE 1

| | Additive element | Additive material | Mixing ratio |
|---|---|---|---|
| Example 1 | Zn | zinc phosphate tetrahydrate | — |
| Example 2 | B | boric acid | — |
| Example 3 | Na | sodium dihydrogenphosphate | — |
| Example 4 | Ba | barium hydrogenphosphate | — |
| Example 5 | Zn, Ba | zinc phosphate tetrahydrate, barium hydrogenphosphate | 1:1 |
| Example 6 | Zn, Na | zinc phosphate tetrahydrate, sodium dihydrogenphosphate | 1:1 |
| Example 7 | Ba, Na | barium hydrogenphosphate, sodium dihydrogenphosphate | 1:1 |
| Example 8 | Mg | magnesium hydrogenphosphate | — |
| Comparative Example 1 | none | — | — |

Thereafter, the bismuth based glass which was used as the starting glass particle was added to the soft magnetic material, wherein the content of Bi was 0.4 mass % relative to the soft magnetic material. The mixture was added to a mixer (trade name: V Mixer, prepared by Tsutsui Scientific Instruments Co., Ltd) and then mixed. The mixed mixture, as the sample for evaluation of the magnetic properties, was molded under a pressure of 981 MPa to prepare a toroidal magnetic core with an outer diameter of 17.5 mm, an inner diameter of 10 mm and a thickness of 4 mm. In addition, the mixture was molded under a pressure of 981 MPa into a bar-like sample with a length of 30 mm, a width of 10 mm and a thickness of 5.5 mm. The bar-like sample was used as the sample for the measurement of electrical resistivity and the sample for the three point bending flexural test. Thereafter, a heat treatment was performed at a temperature of 450° C. under air for 1 hour so that the soft magnetic powder core was obtained.

Figure 3:
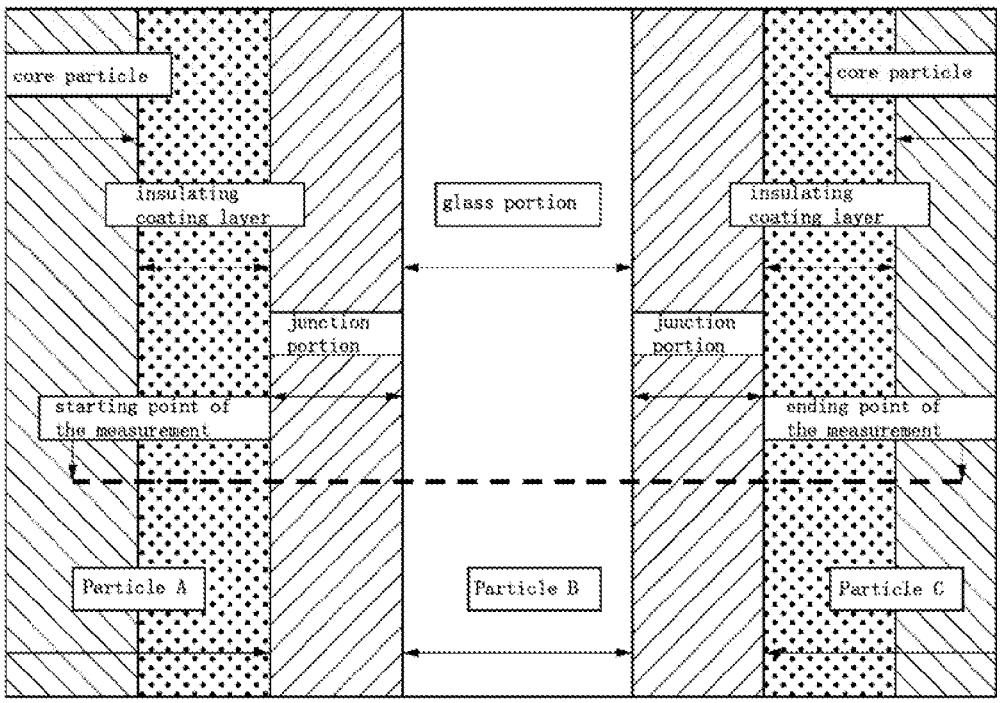
FIG. 3 is a schematic view showing the measurement points in the TEM test.
Figure 4:
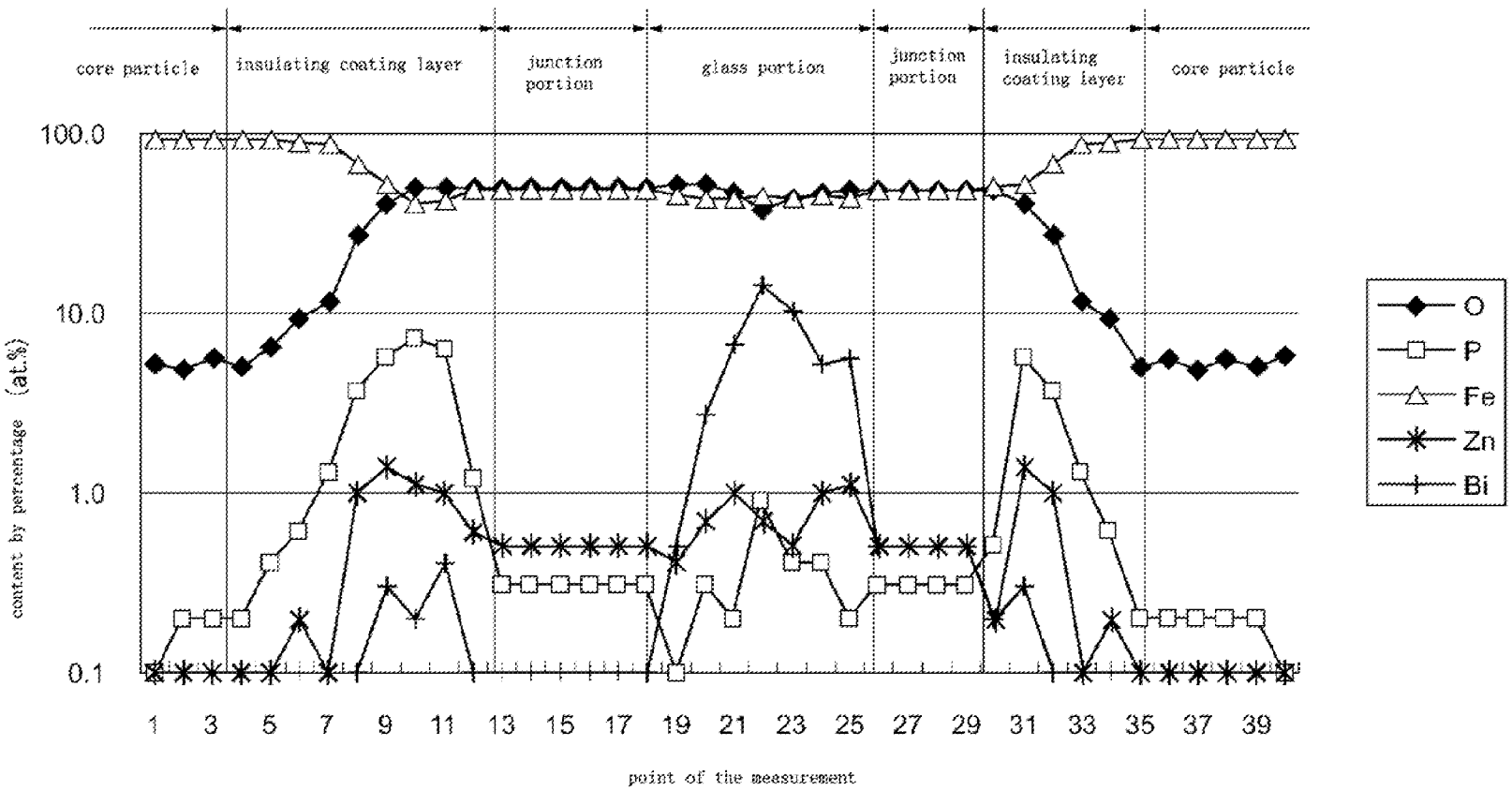
FIG. 4 is a graph showing the composition of the soft magnetic powder core of Example 1.

The structure of the soft magnetic powder core obtained in Example 1 was confirmed by the observation via a TEM. In the observation via TEM, the bar-like sample was cut with a cross section of 10 mm×5.5 mm and then mirror polished. Then, the sample for observation was prepared by a micro-sampling method which used the Dual-BeamFIB (Nova200). After the sample was prepared, the composition was analyzed by an EDS (Energy Dispersive X-ray Spectrometer) using a scanning transmission electron microscope (HD2000, made by HITACHI) at an acceleration voltage of 200 kV. In the analysis of the composition, the diameter of the beam was 1 nm, the objective aperture was 40 μm, and 30 to 40 points were measured at the interface between particles with an equal distance. FIG. 3 was a schematic view showing the measurement points in the TEM measurement. As shown in FIG. 3, the measurement points mentioned above were measured in order in the soft magnetic powder core from the inside of the core particle of any soft magnetic particle A to the inside of the core particle of the adjacent soft magnetic particle C stepping over a particle B (the glass portion). In this way, the composition was analyzed. FIG. 4 was a graph showing the composition of the soft magnetic powder core of Example 1. As shown in FIG. 4, it was determined that in the soft magnetic powder core of Example 1, the core particles have the core particles with iron as the main component and the insulating coating layer containing Fe, O, P and the additive element Zn. The junction portion with iron oxide as the main component was formed between the core particle and the glass portion containing Bi, Fe and P.

Figure 5:
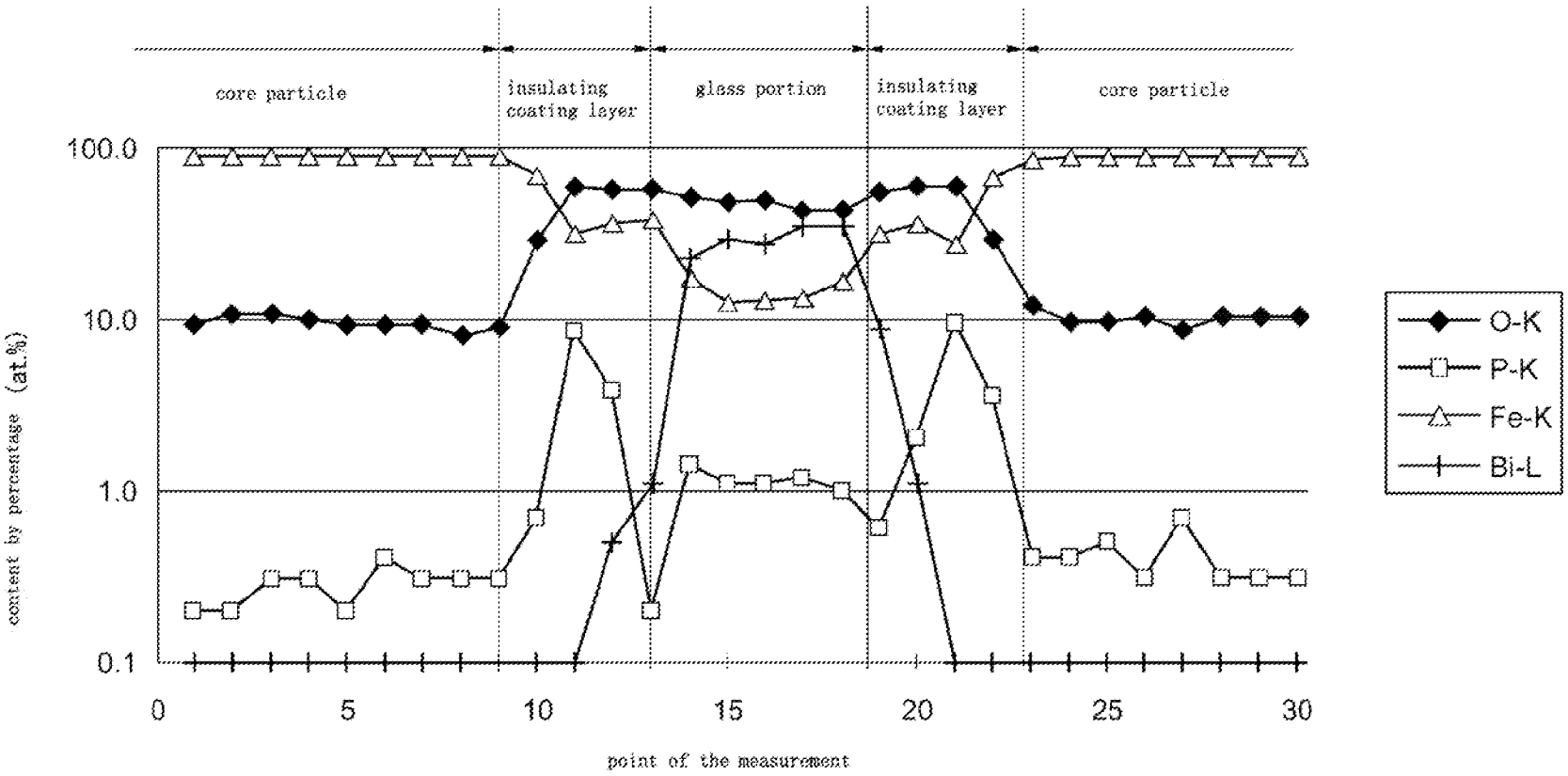
FIG. 5 is a graph showing the composition of the soft magnetic powder core of Comparative Example 1.

The structure of the soft magnetic powder core obtained in Comparative Example 1 was determined by the observation via a TEM. FIG. 5 was a graph showing the composition of the soft magnetic powder core of Comparative Example 1. In the powder core of Comparative Example 1 shown in FIG. 5, the core particles have the core particles with iron as the main component and the insulating coating layer containing Fe, O and P. Further, the glass portion containing Bi, Fe and P was also present among the soft magnetic particles. However, it was determined that no junction portion with iron oxide as the main component was formed between the soft magnetic particle and the glass portion.

<Method for Evaluation>

In the evaluation of the magnetic properties, the coil was wound around the toroidal magnetic core (primary winding: 50 ts, secondary winding: 10 ts). The hysteresis loop in the DC magnetic field was measured using a test apparatus for the DC magnetizing property (trade name: SK110, prepared by METRON, Inc.), and the value of the magnetic flux density was obtained under a magnetic field of 10000 A/m. In the three point bending flexural test, the strength of JISZ2511 was measured by a universal testing machine (trade name: Instron 4505, prepared by INSTRON corporation). In the measurement of the electrical resistivity, with respect to the sample for measurement of electrical resistivity, both end sides (rectangle, 10×5.5) were polished and then coated with the In—Ga paste to form the terminal electrodes. A low resistance meter (MODEL3569, prepared by Tsuruga Electric Corporation) was used to measure the electrical resistance between two terminals.

The measurement results of each Example and each Comparative Example were shown in Table 2.

TABLE 2

| | Additive element | Strength (MPa) | Electrical resistivity (μΩ · m) | Magnetic flux density (mT) | Density (g/cm$^3$) |
|---|---|---|---|---|---|
| Example 1 | Zn | 221 | 1182 | 1585 | 7.546 |
| Example 2 | B | 216 | 2412 | 1581 | 7.503 |
| Example 3 | Na | 190 | 1408 | 1601 | 7.525 |
| Example 4 | Ba | 190 | 1376 | 1587 | 7.504 |
| Example 5 | Zn, Ba | 212 | 1078 | 1595 | 7.561 |
| Example 6 | Zn, Na | 198 | 1799 | 1600 | 7.559 |
| Example 7 | Ba, Na | 193 | 1612 | 1602 | 7.583 |
| Example 8 | Mg | 185 | 383 | 1577 | 7.564 |
| Comparative Example 1 | None | 151 | 923 | 1597 | 7.581 |

As shown in Table 2, it was determined that the magnetic flux density was 1500 mT or more and the three point bending flexural strength was 180 MPa or more in Examples 1 to 8 in which Fe, P, O and additive element(s) were contained in the insulating coating layer. In addition, in Example 1 in which the junction portion was confirmed to exist between the soft magnetic particle and the glass portion from the structural analysis via the TEM, the strength (the three point bending flexural strength) was determined to be especially high. However, in Comparative Example 1, no junction portion was found according to the result from the same structural analysis via the TEM. It can be known that the formation of the junction portion was very important to the increase of the strength. Also, it was determined that three properties (the electrical resistivity (1000 μΩ·m or more), the three point bending flexural strength and the magnetic flux density) were all good in Examples 1 to 7 in which the insulating coating layer contained at least one element selected from the group consisting of Zn, B, Na and Ba.

Example 9

The pure iron (trade name: ABC100.30, with an average particle size of 100 μm, prepared by Höganäs AB) was prepared as the core particle with iron as the main component (the starting powder). Then, phosphoric acid of 0.2 mass % relative to the starting powder and zinc phosphate tetrahydrate of 0.004 mass % relative to the starting powder were dissolved in IPA to prepare a solution for the insulating layer coating treatment. After that, the starting powder and the solution for the insulating layer coating treatment were mixed and left to be dried so as to produce the soft magnetic material.

Thereafter, the bismuth based glass which was used as the starting glass particle was added to the soft magnetic material, wherein the content of Bi was 0.07 mass % relative to the soft magnetic material. The mixture was added to a mixer (trade name: V Mixer, made by Tsutsui Scientific Instruments Co., Ltd) and then mixed. The mixed mixture, as the sample for evaluation of the magnetic properties, was molded under a pressure of 981 MPa to prepare a toroidal magnetic core with an outer diameter of 17.5 mm, an inner diameter of 10 mm and a thickness of 4 mm. In addition, the mixture was molded under a pressure of 981 MPa into a bar-like sample with a length of 30 mm, a width of 10 mm and a thickness of 5.5 mm. The bar-like sample was used as the sample for the measurement of electrical resistivity and the sample for the three point bending flexural test. Thereafter, a heat treatment was performed at a temperature of 450° C. under air atmosphere so that the soft magnetic powder core was obtained.

Example 10

The pure iron (trade name: ABC100.30, with an average particle size of 100 μm, prepared by Höganäs AB) was prepared as the core particle with iron as the main component (the starting powder). Then, phosphoric acid of 0.2 mass % relative to the starting powder and zinc phosphate tetrahydrate of 0.004 mass % relative to the starting powder were dissolved in IPA to prepare a solution for the insulating layer coating treatment. After that, the starting powder and the solution for the insulating layer coating treatment were mixed and left to be dried so as to produce the soft magnetic material.

Thereafter, the bismuth based glass which was used as the starting glass particle was added to the soft magnetic material, wherein the content of Bi was 3.97 mass % relative to the soft magnetic material. The mixture was added to a mixer (trade name: V Mixer, prepared by Tsutsui Scientific Instruments Co., Ltd) and then mixed. The mixed mixture, as the sample for evaluation of the magnetic properties, was molded at a temperature of 130° C. under a pressure of 981 MPa to prepare a toroidal magnetic core with an outer diameter of 17.5 mm, an inner diameter of 10 mm and a thickness of 4 mm. In addition, the mixture was subjected to a warm forming process at a temperature of 130° C. under a pressure of 981 MPa and then formed as a bar-like sample with a length of 30 mm, a width of 10 mm and a thickness of 5.5 mm. The bar-like sample was used as the sample for the measurement of electrical resistivity and the sample for the three point bending flexural test. Thereafter, a heat treatment was performed at a temperature of 450° C. under air atmosphere so that the soft magnetic powder core was obtained.

Example 11

The pure iron (trade name: ABC100.30, with an average particle size of 100 μm, prepared by Höganäs AB) was prepared as the core particle with iron as the main component (the starting powder). Then, phosphoric acid of 0.2 mass % relative to the starting powder and zinc phosphate tetrahydrate of 0.004 mass % relative to the starting powder were dissolved in IPA to prepare a solution for the insulating layer coating treatment. After that, the starting powder and the solution for the insulating layer coating treatment were mixed and left to be dried so as to produce the soft magnetic material.

Thereafter, the bismuth based glass which was used as the starting glass particle was added to the soft magnetic material, wherein the content of Bi was 0.04 mass % relative to the soft magnetic material. The mixture was added to a mixer (trade name: V Mixer, prepared by Tsutsui Scientific Instruments Co., Ltd) and then mixed. The mixed mixture, as the sample for evaluation of the magnetic properties, was molded under a pressure of 981 MPa to prepare a toroidal magnetic core with an outer diameter of 17.5 mm, an inner diameter of 10 mm and a thickness of 4 mm. In addition, the mixture was molded under a pressure of 981 MPa as a bar-like sample with a length of 30 mm, a width of 10 mm and a thickness of 5.5 mm. The bar-like sample was used as the sample for the measurement of electrical resistivity and the sample for the three point bending flexural test. Thereafter, a heat treatment was performed at a temperature of 450° C. under air atmosphere so that the soft magnetic powder core was obtained.

Example 12

The pure iron (trade name: ABC100.30, with an average particle size of 100 μm, prepared by Höganäs AB) was prepared as the core particle with iron as the main component (the starting powder). Then, phosphoric acid of 0.2 mass % relative to the starting powder and zinc phosphate tetrahydrate of 0.004 mass % relative to the starting powder were dissolved in IPA to prepare a solution for the insulating layer coating treatment. After that, the starting powder and the solution for the insulating layer coating treatment were mixed and left to be dried so as to produce the soft magnetic material.

Thereafter, the bismuth based glass which was used as the starting glass particle was added to the soft magnetic material, wherein the content of Bi was 4.17 mass % relative to the soft magnetic material. The mixture was added to a mixer (trade name: V Mixer, prepared by Tsutsui Scientific Instruments Co., Ltd) and then mixed. The mixed mixture, as the sample for evaluation of the magnetic properties, was molded at a temperature of 130° C. under a pressure of 981 MPa to prepare a toroidal magnetic core with an outer diameter of 17.5 mm, an inner diameter of 10 mm and a thickness of 4 mm. In addition, the mixture was subjected to a warm forming process at a temperature of 130° C. under a pressure of 981 MPa and then formed as a bar-like sample with a length of 30 mm, a width of 10 mm and a thickness of 5.5 mm. The bar-like sample was used as the sample for the measurement of electrical resistivity and the sample for the three point bending flexural test. Thereafter, a heat treatment was performed at a temperature of 450° C. under air atmosphere so that the soft magnetic powder core was obtained.

The magnetic flux density, the three point bending strength and the electrical resistivity were measured by the evaluation methods mentioned above. The measurement results were shown in Table 3.

The content of Bi in the soft magnetic powder core was measured by an ICP atomic emission spectrophotometer (the ICP-AES device). Three sample sheets with a length of 5 mm, a width of 10 mm and a thickness of 5.5 mm were cut from the bar-like sample mentioned above. These samples were respectively weighed and then dissolved with heat in aqua regia. After that, the solution was put into a volumetric flask of 100 ml and aqua regia was added until the total volume reached 100 ml. Then, 10 ml of the solution was separated and the content of Bi was measured by using the ICP-AES device (SPS3100, prepared by Seiko Instruments Inc.). The average was calculated from 3 points. The analysis results were shown in Table 3.

Figure 6:
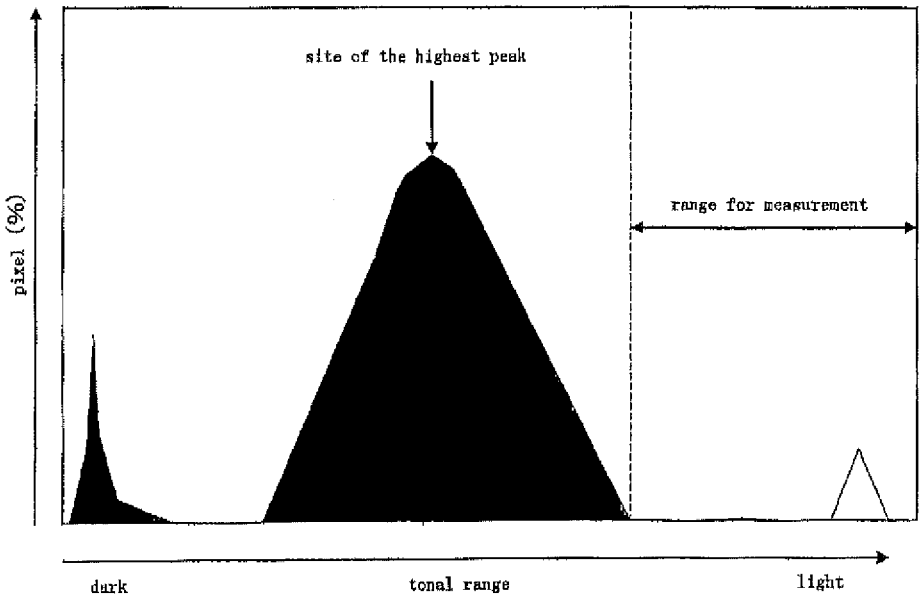
FIG. 6 is a schematic histogram.

The area ratio and the average area of the glass portion at the cross section of the soft magnetic powder core were calculated by using a software for image analysis (Pixs2000_Pro, prepared by Innotech Corporation). The sample for cross section observation was prepared by cutting the bar-like sample along a plane parallel to the direction in which the pressure was applied (a rectangle, 10 mm×5.5 mm) and then mirror polishing the cross section. The compo image taken by SEM was saved as a bitmap file with a resolution of 640×480 pixels. Because of Bi with a high specific gravity, the glass portion was shown as a light portion. Herein, the tonal range from the point with a pixel less than 0.1% to the point with a pixel of 255 at the light side of the highest peak shown in the histogram from the image software (Irfan view) was deemed as the glass portion. The measurement was performed via the function of automated colony counter in the software for image analysis in a region with an area of 1.1 $mm^2$ or more and 1.2 $mm^2$ or less, wherein 2 to 10000000 dots without those at the boundary were extracted and measured in the brightness tonal range described above. The measurement was done in three images and the average was then calculated. FIG. 6 was a schematic histogram. The analysis results were shown in Table 3.

TABLE 3

| | strength (MPa) | Electrical resistivity (μΩ • m) | Magnetic flux density (mT) | Content of Bi (%) | Area ratio of glass portion (%) | Average area of glass portion ($\mu m^2$) | Measured area ($mm^2$) |
|---|---|---|---|---|---|---|---|
| Example 9 | 193 | 1032 | 1617 | 0.07 | 0.12 | 15.5 | 1.17 |
| Example 10 | 181 | 3104 | 1512 | 3.97 | 4.55 | 34.5 | 1.16 |
| Example 11 | 179 | 633 | 1625 | 0.04 | 0.07 | 9.5 | 1.17 |
| Example 12 | 161 | 3573 | 1341 | 4.17 | 5.73 | 42.1 | 1.16 |

As shown in Table 3, the strength was higher in Examples 9 to 12 compared to Comparative Example 1. Especially in Example 9 and Example 10, the three point bending strength, the electrical resistivity and the magnetic flux density were confirmed to be high when the content of Bi was 0.05 mass % or more and 4.00 mass % or less. In addition, in the cross section of the soft magnetic powder core with an area of 1.1 $mm^2$ or more and 1.2 $mm^2$ or less, the electrical resistivity, the magnetic flux density and the strength were all high when the area ratio of the glass portion was 0.5% or more and 5% or less and the average area of the glass portion was 10 $\mu m^2$ or more and 40 $\mu m^2$ or less.

As described above, the soft magnetic powder core can be widely and effectively used in the motors, actuators, generators, reactors and various machines, equipments, and systems having these motors, actuators, generators or reactors because it has a high electrical resistivity, a high magnetic flux density and a high strength.

DESCRIPTION OF REFERENCE NUMERALS

1 soft magnetic particle
1*a*. core particle
1*b*. insulating coating film
2 glass portion
3 junction portion

What is claimed is:

1. A soft magnetic powder core, wherein,
glass portions are scattered among soft magnetic particles,
each of said soft magnetic particles comprises a core particle with iron as the main component and an insulating coating layer containing at least P, O and Fe, a junction portion with iron oxide as the main component is further formed between each of said soft magnetic particles and each of said glass portions.

2. The soft magnetic powder core of claim 1, wherein, said insulating coating layer further contains at least one element selected from the group consisting of B, Na, Zn and Ba.

3. The soft magnetic powder core of claim 1, wherein, each of said glass portions contains Bi, Fe and P.

4. The soft magnetic powder core of claim 1, wherein, said soft magnetic powder core contains Bi, and the content of Bi is 0.05 mass % or more and 4.00 mass % or less.

5. The soft magnetic powder core of claim 1, wherein, in any cross section of said soft magnetic powder core with an area of 1.1 $mm^2$ or more and 1.2 $mm^2$ or less, the area ratio of said glass portions is 0.1% or more and 5.0% or less and the average area of said glass portions is 10 $\mu m^2$ or more and 40 $\mu m^2$ or less.

6. The soft magnetic powder core of claim 2, wherein, each of said glass portions contains Bi, Fe and P.

7. The soft magnetic powder core of claim 2, wherein, said soft magnetic powder core contains Bi, and the content of Bi is 0.05 mass % or more and 4.00 mass % or less.

8. The soft magnetic powder core of claim 3, wherein, said soft magnetic powder core contains Bi, and the content of Bi is 0.05 mass % or more and 4.00 mass % or less.

9. The soft magnetic powder core of claim 6, wherein, said soft magnetic powder core contains Bi, and the content of Bi is 0.05 mass % or more and 4.00 mass % or less.

10. The soft magnetic powder core of claim 2, wherein, in any cross section of said soft magnetic powder core with an area of 1.1 $mm^2$ or more and 1.2 $mm^2$ or less, the area ratio of said glass portions is 0.1% or more and 5.0% or less and the average area of said glass portions is 10 $\mu m^2$ or more and 40 $\mu m^2$ or less.

11. The soft magnetic powder core of claim 3, wherein, in any cross section of said soft magnetic powder core with an area of 1.1 $mm^2$ or more and 1.2 $mm^2$ or less, the area ratio of said glass portions is 0.1% or more and 5.0% or less and the average area of said glass portions is 10 $\mu m^2$ or more and 40 $\mu m^2$ or less.

12. The soft magnetic powder core of claim 6, wherein, in any cross section of said soft magnetic powder core with an area of 1.1 $mm^2$ or more and 1.2 $mm^2$ or less, the area ratio of said glass portions is 0.1% or more and 5.0% or less and the average area of said glass portions is 10 $\mu m^2$ or more and 40 $\mu m^2$ or less.

13. The soft magnetic powder core of claim 4, wherein, in any cross section of said soft magnetic powder core with an area of 1.1 $mm^2$ or more and 1.2 $mm^2$ or less, the area ratio of said glass portions is 0.1% or more and 5.0% or less and the average area of said glass portions is 10 $\mu m^2$ or more and 40 $\mu m^2$ or less.

14. The soft magnetic powder core of claim 7, wherein, in any cross section of said soft magnetic powder core with an area of 1.1 $mm^2$ or more and 1.2 $mm^2$ or less, the area ratio of said glass portions is 0.1% or more and 5.0% or less and the average area of said glass portions is 10 $\mu m^2$ or more and 40 $\mu m^2$ or less.

15. The soft magnetic powder core of claim 8, wherein, in any cross section of said soft magnetic powder core with an area of 1.1 $mm^2$ or more and 1.2 $mm^2$ or less, the area ratio of said glass portions is 0.1% or more and 5.0% or less and the average area of said glass portions is 10 $\mu m^2$ or more and 40 $\mu m^2$ or less.

16. The soft magnetic powder core of claim 9, wherein, in any cross section of said soft magnetic powder core with an area of 1.1 $mm^2$ or more and 1.2 $mm^2$ or less, the area ratio of said glass portions is 0.1% or more and 5.0% or less and the average area of said glass portions is 10 $\mu m^2$ or more and 40 $\mu m^2$ or less.

* * * * *